US005356271A

United States Patent [19]

Miura et al.

[11] Patent Number: 5,356,271

[45] Date of Patent: Oct. 18, 1994

[54] CAPACITY CONTROL MECHANISM FOR SCROLL-TYPE COMPRESSOR

[75] Inventors: Shigeki Miura; Ryuhei Tanigaki; Takayuki Iio, all of Aichi, Japan

[73] Assignee: Mitsubishi Jukogyo Kabushiki Kaisha, Tokyo, Japan

[21] Appl. No.: 13,422

[22] Filed: Feb. 4, 1993

[30] Foreign Application Priority Data

Feb. 6, 1992 [JP] Japan ..... 4-54162

[51] Int. Cl.[5] ..... F04B 49/00

[52] U.S. Cl. ..... 417/310; 417/308

[58] Field of Search ..... 417/310, 308, 440

[56] References Cited

U.S. PATENT DOCUMENTS 5,192,195 3/1993 Iio et al. ..... 417/310
5,193,987 3/1993 Iio et al. ..... 417/310
5,236,316 8/1993 Iio ..... 417/310

FOREIGN PATENT DOCUMENTS 0264949 4/1988 European Pat. Off. .
0354867 2/1990 European Pat. Off. .
3617397 11/1987 Fed. Rep. of Germany .

*Primary Examiner*—Richard E. Gluck
*Assistant Examiner*—Alfred Basichas

[57] ABSTRACT

A first through hole is formed into a shape such that the opening area at the start of the opening increases gradually along with the movement of a piston valve or an auxiliary through hole is provided in a cylinder to introduce the gas being compressed into a suction-side chamber by being opened by the piston valve before the first through hole is opened, so that the gas being compressed is prevented from suddenly entering the suction-side chamber when the piston valve moves in the cylinder.

6 Claims, 10 Drawing Sheets

CAPACITY CONTROL MECHANISM FOR SCROLL-TYPE COMPRESSOR

FIELD OF THE INVENTION AND RELATED ART STATEMENT

This invention relates to an improvement of a capacity control mechanism for a scroll-type compressor.

One example of the scroll-type compressor of the related art is shown in FIGS. 7 through 13.

In FIG. 7, reference numeral 1 denotes a housing. The housing 1 comprises a cup-shaped body 2, a front end plate 4 fastened to the cup-shaped body 2 with bolts 3, and a cylindrical member 6 fastened to the front end plate 4 with bolts 5. A main shaft 7 passing through the cylindrical member 6 is rotatably supported by the housing 1 via bearings 8 and 9.

The housing 1 incorporates a fixed scroll 10 and a rotary scroll 14.

The fixed scroll 10 has an end plate 11 and a spiral lap 12 installed on the inner surface of the end plate 11. A discharge port 29 is disposed at the center of the end plate 11 and a pair of bypass ports 33*a*, 33*b* communicating with compression chambers 19*a* and 19*b* during compression are also disposed on end plate 11.

The rotary scroll has an end plate 15 and a spiral lap 16 installed on the inner surface of the end plate 15. The shape of the spiral lap 16 is substantially the same as that of the spiral lap 12 of the fixed scroll 10.

The rotary scroll 14 and the fixed scroll 10 are off-centered mutually by the radius of revolution and engaged with each other at a shifted angle of 180° as shown in the figure.

A tip seal 17 embedded in the tip end of spiral lap 12 is in contact with the inner surface of the end plate 15, while the tip seal 18 embedded in the tip end of spiral lap 16 is in contact with the inner surface of the end plate 11. The side surfaces of the spiral laps 12 and 16 are in linear contact with each other at a plurality of places, and a plurality of compression chambers 19*a*, 19*b* which are symmetric with respect to the center of spiral are formed.

Inside a cylindrical boss 20 extending at the center of the outer surface of the end plate 15, a drive bushing 21 is rotatably fitted via a bearing 23. In an eccentric bore 24 made in the drive bushing 21, an eccentric pin 25 extending eccentrically from the inner end of the main shaft 7 is rotatably inserted. On this drive bushing 21, a balance weight 27 is installed.

Between the outer periphery of outer surface of the end plate 15 and the inner surface of the front end plate 4, a rotation inhibiting mechanism 40, which is also used as a thrust bearing, is disposed.

A capacity control block 50 is installed in such a manner as to be in contact with the outer surface of the end plate 11 of the fixed scroll 10. The convex portion 51 of the capacity control block 50 is engaged with the concave portion 10*a* disposed on the fixed scroll 10. The capacity control block 50 is fixed together with the fixed scroll 10 in the housing 1 with bolts 13 which pass through the cupshaped body 2 and bolt holes 52 made in the capacity control block 50, and are screwed in the fixed scroll 10. The rear outer peripheral surface of the capacity control block 50 is in contact with the inner peripheral surface of the cupshaped body 2, by which the inside of the housing 1 is divided into a suction chamber 28 and a discharge cavity 31.

At the center of the capacity control block 50, a discharge hole 53 communicating with the discharge port 29 is provided. The discharge hole 53 is opened/-closed by a discharge valve 30 which is fastened together with a retainer 35 to the outer surface of control block 50 with a bolt 36, as shown in FIG. 11.

As shown in FIG. 12, a blind hole shaped cylinder 54 is provided on one side of the discharge hole 53, and a blind hole shaped cavity 55 is provided in parallel to the cylinder 54 on the other side thereof. The open ends of the cylinder 54 and the cavity 55 communicate with the suction chamber 28.

In the cylinder 54, a cup-shaped piston valve 56 is incorporated sealingly and slidably. On one end side of the piston valve 56, a control pressure chamber 80 is defined, and a suction-side chamber 81 defined on the other end side thereof communicates with the suction chamber 28. The piston valve 56 is pushed against the bottom of cylinder 54 by a coil spring 83 interposed between the piston valve 56 and a spring shoe 82. An annular groove 93 disposed at the outer peripheral surface of the piston valve 56 always communicates with the suction-side chamber 81 via a plurality of holes 94.

In the cavity 55, a control valve 58 is installed. By dividing the gap between the cavity 55 and the control valve 58 with O-rings 59, 60, 61, 62, an atmospheric pressure chamber 63, a low pressure chamber 64, a control pressure chamber 65, and a high pressure chamber 66 are defined. The atmospheric pressure chamber 63 communicates with the atmosphere outside the housing 1 via a through hole 67 and a not illustrated connecting pipe. The low pressure chamber 64 communicates with the suction chamber 28 via a through hole 68. The control pressure chamber 65 communicates with the control pressure chamber 80 via a through hole 69, a groove 70, and a through hole 71 as shown in FIG. 8. The high pressure chamber 66 communicates with the discharge cavity 31 via a through hole 72 as shown in FIG. 7. The control valve 58 incorporates a valve mechanism. This valve mechanism senses high pressure HP in the discharge cavity 31 and low pressure LP in the suction chamber 28, and produces control pressure AP, which is an intermediate pressure between the high pressure and the low pressure and can be represented as a linear function of low pressure LP.

As shown in FIG. 13, grooves 70, 90, 91 and recesses 86, 87*a*, 87*b*, 88 are formed on the inner surface of the capacity control block 50. A land portion 57 surrounding the recesses 86, 87*a*, 87*b*, and 88 is provided with a seal groove 84, in which a seal material 85 is installed. By bringing the seal material 85 into contact with the outer surface of the end plate 11 of the fixed scroll 10, the recesses 86, 87*a*, 87*b* and 88 are divided from each other. The recess 87*a* is divided from the recess 87*b* by a partition 97. The recess 86 communicates with the control pressure chambers 65 and 80 via the groove 70 and through holes 69, 71. The recesses 87*a*, 87*b* communicate with the compression chamber 19*a*, 19*b* during compression via bypass ports 33*a*, 33*b* disposed in the end plate 11, respectively, as shown in FIG. 7, and communicate with the suction-side chamber 81 via first through holes 89*a*, 89*b* provided in the cylinder 54 as shown in FIG. 12. The recess 88 communicates with the discharge hole 53 via grooves 90, 91, and communicates with the suction-side chamber 81 via a second through hole 92 provided in the cylinder 54, the annular groove 93 provided in the outer peripheral surface of the piston valve 56, and holes 94. The bypass ports 33*a*, 33*b* are located at a position communicating with the compression chambers 19*a*, 19*b* until the suction of gas is completed, the compression stroke starts, and the capacity is reduced to 50%.

When the main shaft 7 is rotated, the rotary scroll 14 is driven via a rotation drive mechanism consisting of the eccentric pin 25, the drive bushing 21, the boss 22 and the like. The rotary scroll 14 revolves on a circular trajectory with a radius of offset between the main shaft 7 and the eccentric pin 25 while its rotation is inhibited by the rotation inhibiting mechanism 40. Then, the linear contact portion between the spiral laps 12 and 16 gradually moves toward the center of spiral; as a result, the compression chambers 19*a*, 19*b* move toward the center of spiral while their volumes are reduced. Accordingly, a gas flowing into the suction chamber 28 through a not illustrated suction port is introduced into the compression chambers 19*a*, 19*b* through the outer peripheral end opening of the spiral laps 12 and 18. The gas reaches the central portion while being compressed, passes through the discharge port 29, and is discharged into the discharge cavity 31 by pushing the discharge valve 30 to open it. Then, the gas flows out through a not illustrated discharge port.

When the capacity of the compressor is set to 0%, the control valve 58 develops a control pressure AP of low value. This control pressure AP is introduced into the control pressure chamber 80 via the through hole 69, the groove 70, and the through hole 71. However, since its pressure is low, the piston valve 56 is pushed by the restoring force of coil spring 83 and is positioned as shown in FIG. 12. Thus, the first through holes 89*a*, 89*b* and the second through hole 92 are all opened, so that the gas being compressed in the compression chambers 19*a*, 19*b* enters the suction-side chamber 81 via the bypass ports 33*a*, 33*b*, recesses 87*a*, 87*b*, and the first through holes 89*a*, 89*b*. On the other hand, the compressed gas reaching the center of spiral enters the suction-side chamber 81 via the discharge port 29, the discharge hole 53, the recess 88, the grooves 90, 91, the second through hole 92, the groove 93, and the holes 94. These two gases join in the suction-side chamber 81, and are discharged into the suction chamber 28. As a result, the capacity of compressor becomes zero.

When the compressor is operated at full load, that is, its capacity is 100% maximum, the control valve 58 develops a control pressure AP of high value. This control pressure AP of high value enters the control pressure chamber 80, and pushes the end face of the piston valve 56. Thus, the piston valve 56 retracts against the tension force of the coil spring 83, and is located at the position where its outer end abuts the spring shoe as shown in FIG. 8. In this state, the first through holes 89*a*, 89*b* and the second through hole 92 are closed by the piston valve 56, so that the compressed gas reaching the center of spiral passes through the discharge port 29 and the discharge hole 53, pushes the discharge valve 30 to open it, and is discharged into the discharge cavity 31.

When the capacity of compressor is reduced, the control valve 58 develops a control pressure AP corresponding to the reduction ratio. When this control pressure AP acts on the end face of piston valve 56 via the control pressure chamber 80, the piston valve 56 stops at the position where the pushing force of control pressure AP balances with the tension force of the coil spring 83. Therefore, when the control pressure AP becomes low, only the first through holes 89*a*, 89*b* are opened. The gas being compressed in the compression chamber 19*a*, 19*b* is discharged into the suction chamber 28 in the amount corresponding to the degree of opening of the first through holes 89*a*, 89*b*, and accordingly the capacity of compressor is decreased. When the control pressure AP decreases further and the first through holes 89*a*, 89*b* are fully opened, the capacity of compressor is decreased to 50%. When the control pressure AP decreases still further, the second through hole 92 is opened. With the second through hole 92 being fully opened, the capacity of compressor becomes zero. Thus, the capacity of compressor varies from 0% to 100%.

The conventional capacity control mechanism described above has the following disadvantages: When the first through holes 89*a*, 89*b* begin to open along with the movement of the piston valve 56, the gas being compressed flows into the suction-side chamber 81 via the first through holes 89*a*, 89*b*, thereby the pressure in the suction-side chamber 81 changes suddenly. Therefore, a hunting phenomenon, in which the stationary state of the piston valve 56 is not stabilized, occurs; as a result, the operation of the compressor becomes unstable, and unusual noise is generated.

OBJECT AND SUMMARY OF THE INVENTION

An object of the present invention is to provide a capacity control mechanism for a scroll-type compressor which provides stabilized operation and prevents the generation of unusual noise.

To this end, in a capacity control mechanism for a scroll-type compressor comprising a control pressure chamber in which a control pressure developed by a control valve is introduced to one side of a piston valve by fitting the piston valve sealingly and slidably in a cylinder, a suction-side chamber which communicates with a suction chamber on the other side of the piston valve, a first through hole which introduces the gas being compressed in the cylinder to the suction-side chamber, and a second through hole which introduces the compressed gas to the suction-side chamber, wherein the first and second through holes are opened in that order by the movement of the piston valve in the cylinder along with the decrease in the control pressure, the capacity control mechanism for a scroll-type compressor is so constructed that the first through hole is shaped so that the opening area at the start of the opening increases gradually along with the movement of the piston valve.

Also, in the present invention, an auxiliary through hole which has a smaller opening area than the first through hole and is opened by the piston valve before the first through hole is opened may be provided to introduce the gas being compressed into the suction-side chamber.

Since the present invention has the above-described constitution, the piston valve moves along with the decrease in control pressure, so that the gas being compressed gradually enters the suction-side chamber. Therefore, the variation in pressure in the suction-side chamber is decreased and the hunting of piston valve is prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the drawings which are given by way of illustration only, and thus are not limitative of the present invention, and wherein.

DETAILED DESCRIPTION OF A PREFERRED EMBODIMENT

Figure 1:
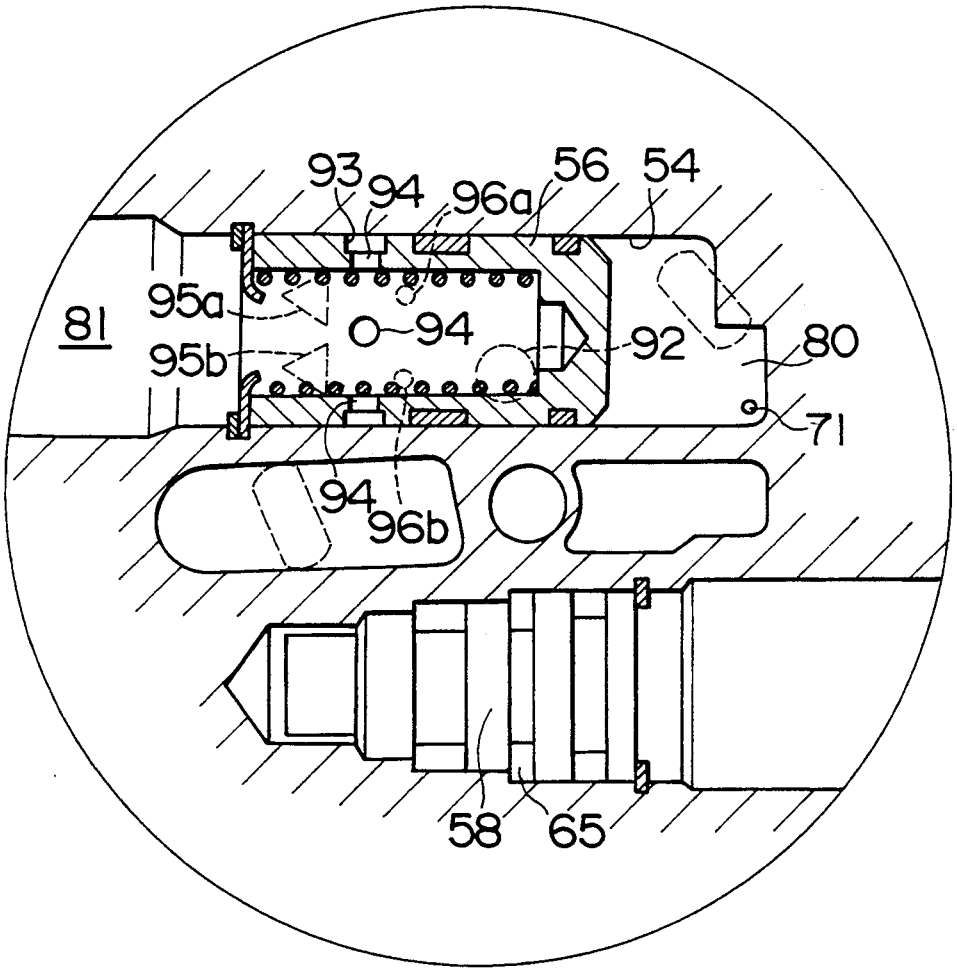
FIG. 1 is a schematic view of the main portion of one embodiment of a capacity control mechanism for a scroll-type compressor in accordance with the present invention, FIGS. 2(*a*), 2(*b*), 2(*c*) are schematic sectional views of the main portion, showing the action of a capacity control mechanism for a scroll-type compressor in accordance with the present invention.
Figure 12:
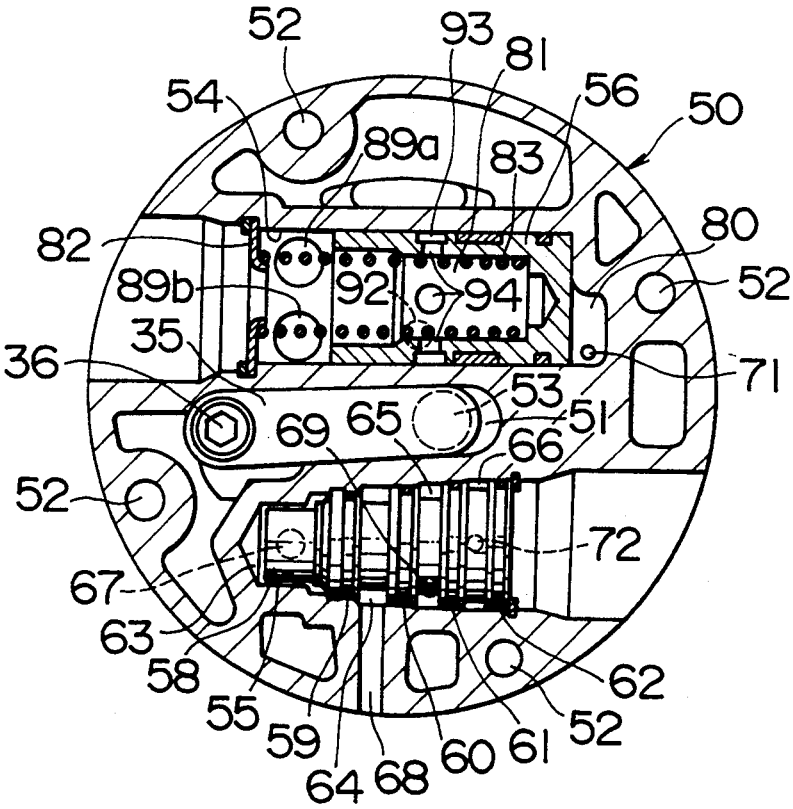
FIG. 12 RELATED ART
FIG. 12 is a sectional view taken along the line XII—XII of FIG. 7.
Figure 13:
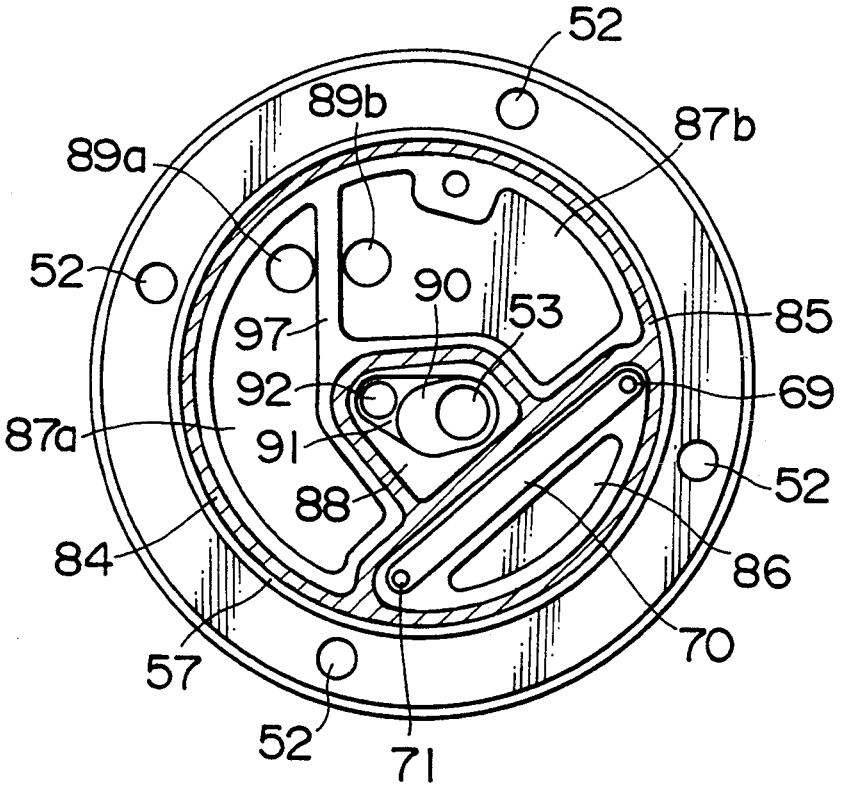
FIG. 13 RELATED ART
FIG. 13 is a end view taken along the line XIII—XIII of FIG. 10.

One embodiment of the present invention is shown in FIG. 1. In a cylinder 54, first through holes 95*a*, 95*b* are provided in place of the first through holes 89*a* and 89*b* shown in FIG. 12. These first through holes 95*a*, 95*b* take a triangular shape whose vertex lies in the direction of the open end of cylinder 54. These two first through holes 95*a*, 95*b* are arranged in parallel so as to open simultaneously by the movement of the piston valve 56. Therefore, at the start of the opening, the opening area increases gradually along with the movement of the piston valve 56. Also, in the cylinder 54 are provided auxiliary through holes 96*a*, 96*b*, which are opened by the piston valve 56 before the first through holes 95*a*, 95*b* are opened. These auxiliary through holes 96*a*, 96*b* have a smaller opening area than the first through holes 95*a*, 95*b*, and are of a circular shape. The auxiliary through holes 96*a*, 96*b* are arranged in parallel so as to open simultaneously by the movement of the piston valve 56. The auxiliary through holes 96*a*, 96*b* communicate with a suction-side chamber 81, like a second through hole 92, via an annular groove 93 and a plurality of holes 94 made in the outer peripheral surface of the piston valve 56. The other constitution is the same as that of the conventional mechanism shown in FIGS. 7 through 13, and the same reference numerals are applied to the corresponding elements.

When the load of the compressor is low, the control pressure AP developed by a control valve 58 decreases, and this control pressure AP is introduced from a control pressure chamber 65 to a control pressure chamber 80. Thus, with a low control pressure AP, the piston valve 56 is pushed by the restoring force of the coil spring 83, and moves to the right from the position shown in FIG. 1. Thus, the auxiliary through holes 96*a*, 96*b* are first opened by aligning with the annular groove 93 as shown in FIG. 2(*a*), and then the first through holes 95*a*, 95*b* are opened and expanded gradually as shown in FIG. 2(*b*).

When the auxiliary through holes 96*a*, 96*b* are opened, the gas being compressed in compression chambers 19*a*, 19*b* is discharged into a suction chamber 28 via bypass ports 33*a*, 33*b*, recesses 87*a*, 87*b*, the auxiliary through holes 96*a*, 96*b*, the annular groove 93, holes 94, and the suction-side chamber 81. When the first through holes 95*a*, 95*b* are opened, the gas being compressed is discharged into the suction chamber 28 via the first through holes 95*a*, 95*b*, and the suction-side chamber 81. Therefore, when the control pressure AP decreases and the piston valve 56 moves, the gas being compressed flows first into the suction-side chamber 81 via the auxiliary through holes 96*a*, 96*b* having a small opening area, then flows into the suction-side chamber 81 via the first through holes 95*a*, 95*b*. Since the gas being compressed flows gradually into the suction-side chamber 81, the variation in pressure in the suction-side chamber 81 decreases, thereby the hunting of the piston valve 56 is prevented.

Figure 2A:
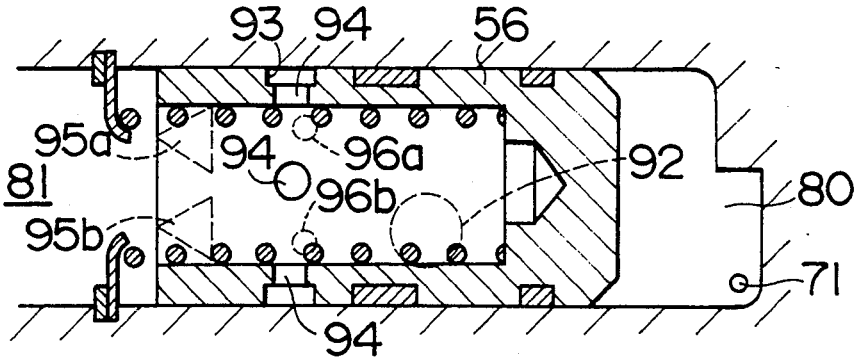
Figure 2B:
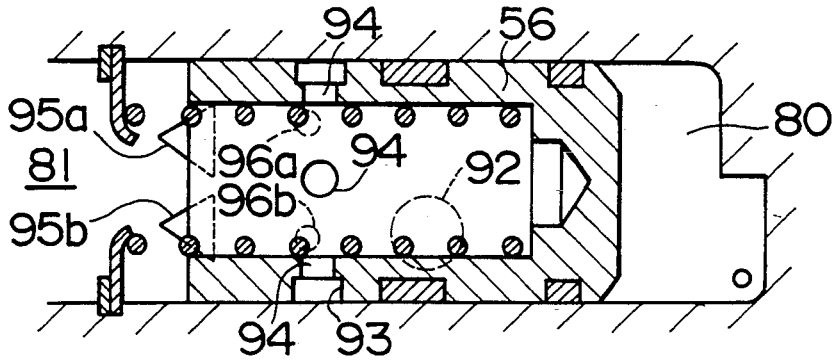
Figure 2C:
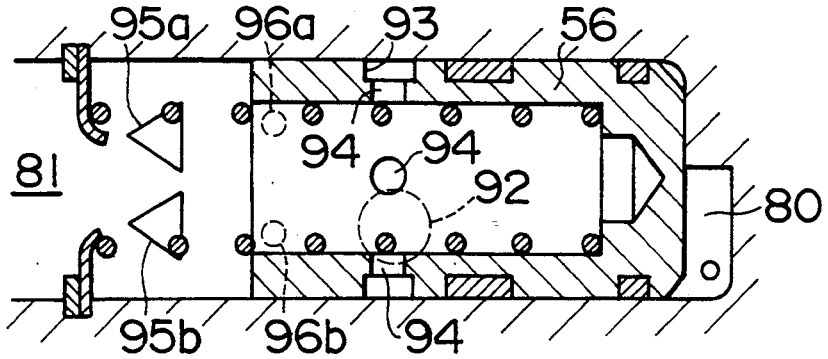

When the piston valve 56 approaches the right end, the second through hole 92 aligns with the annular groove 93 as shown in FIG. 2(*c*), by which the compressed gas in a discharge port 29 is returned to the suction-side chamber 81 via a discharge hole 53, a recess 88, grooves 90, 91, the second through hole 92, the annular groove 93, and the holes 94.

Figure 3:
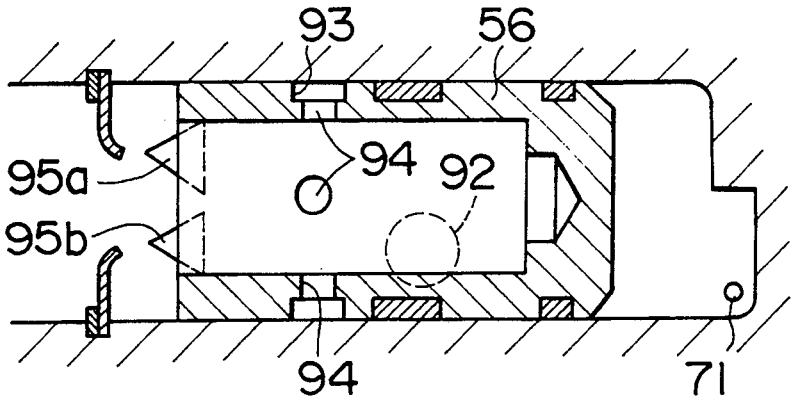
FIG. 3 is a schematic view of the main portion of another embodiment of a capacity control mechanism for a scroll-type compressor in accordance with the present invention.
Figure 4:
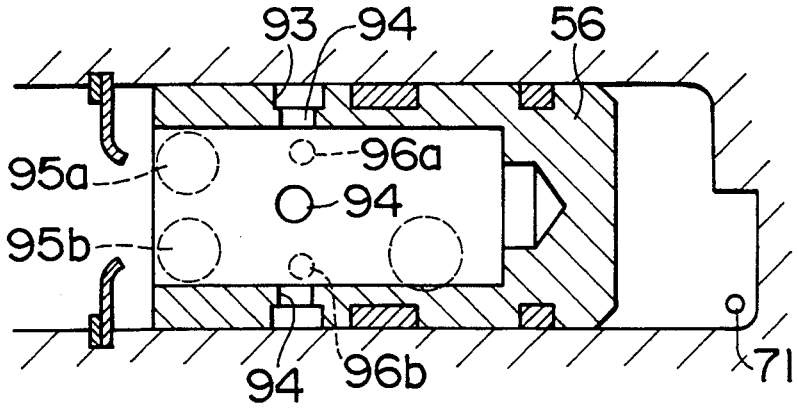
FIG. 4 is a schematic view of the main portion of still another embodiment of a capacity control mechanism for a scroll-type compressor in accordance with the present invention.
Figure 5:
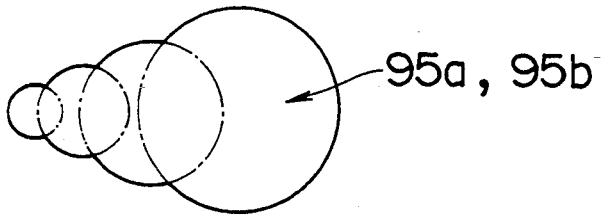
FIGS. 5 and 6 are views showing the variations of first through holes in accordance with the present invention.
Figure 6:
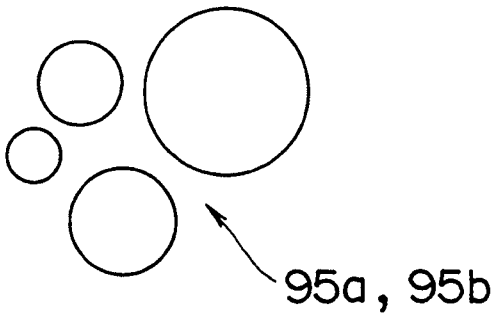
Figure 7:
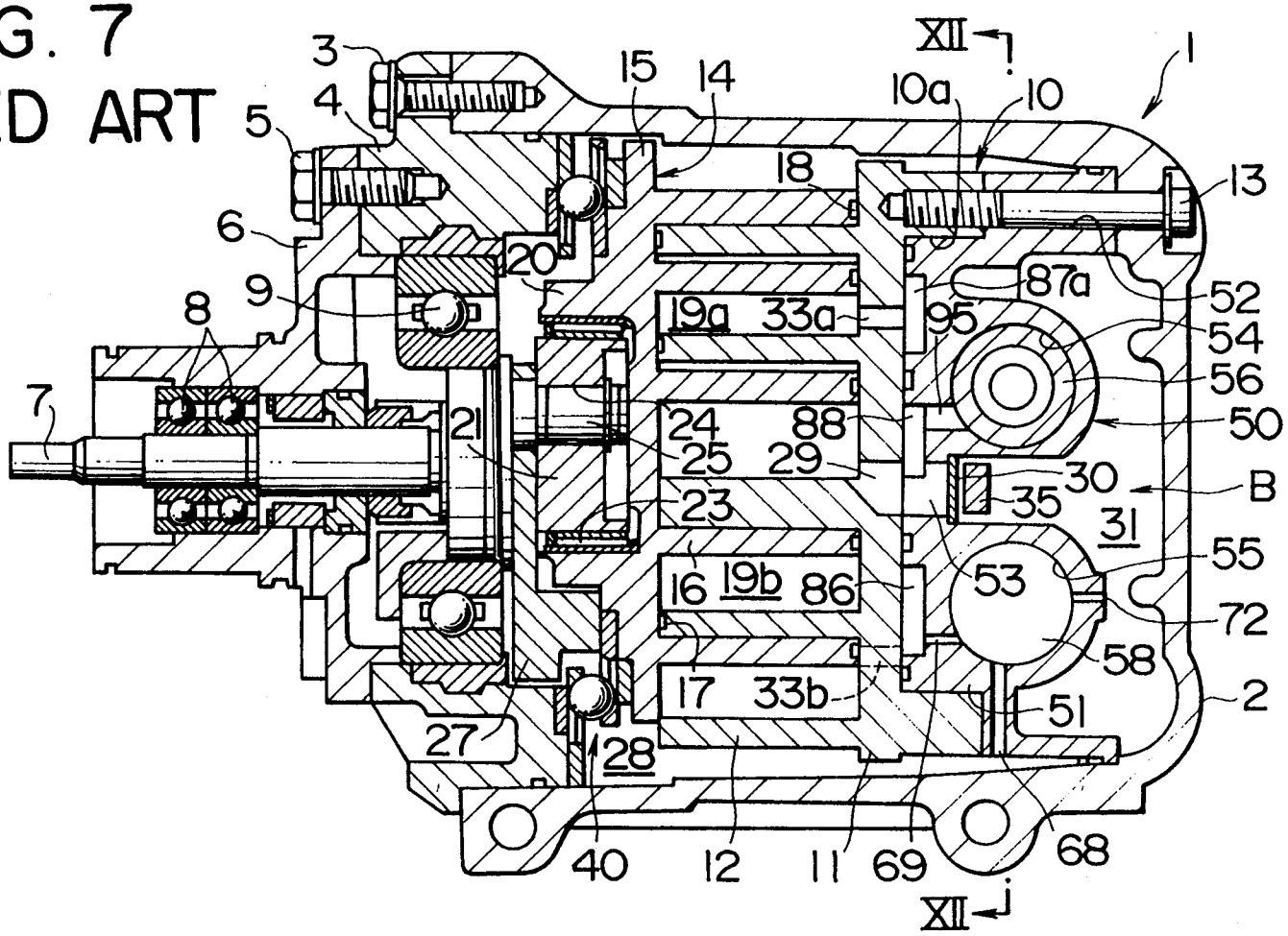
FIG. 7 RELATED ART
FIG. 7 is a longitudinal sectional view of a capacity control mechanism for a scroll-type compressor of related art.
Figure 8:
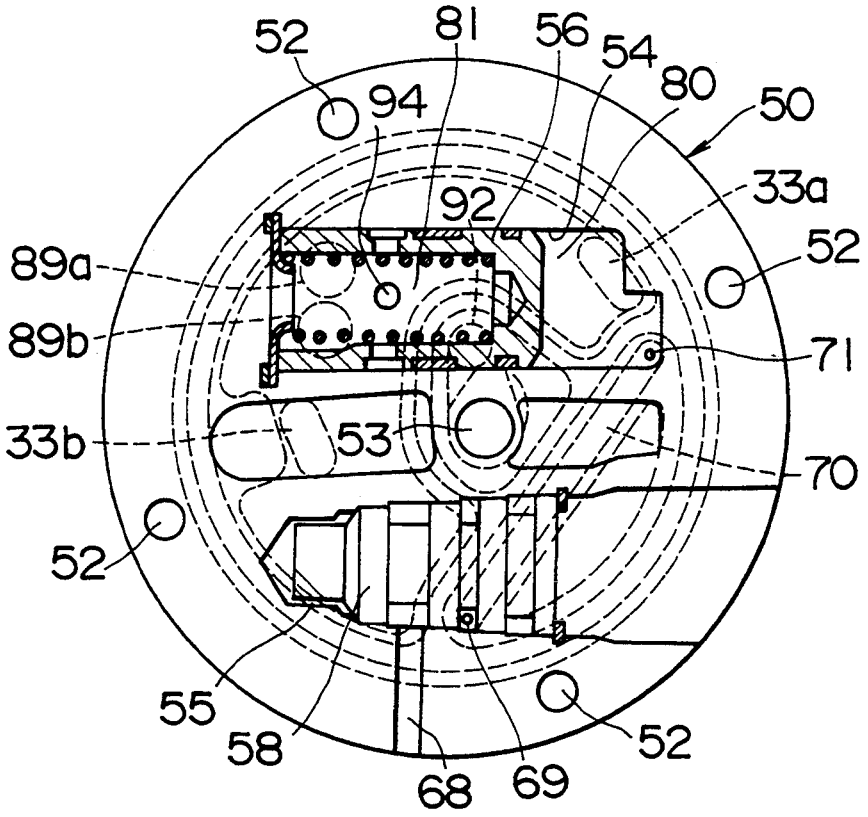
FIG. 8 RELATED ART
FIG. 8 is a schematic sectional view taken along the line XII—XII of FIG. 7.
Figure 9:
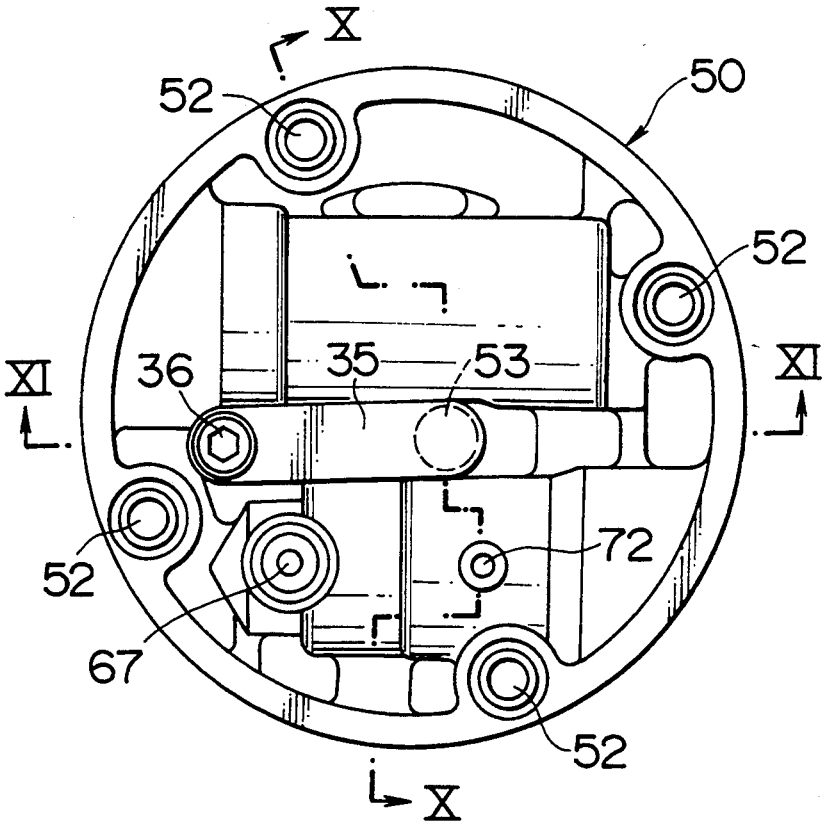
FIG. 9 RELATED ART
FIG. 9 is view B of FIG. 7.
Figure 10:
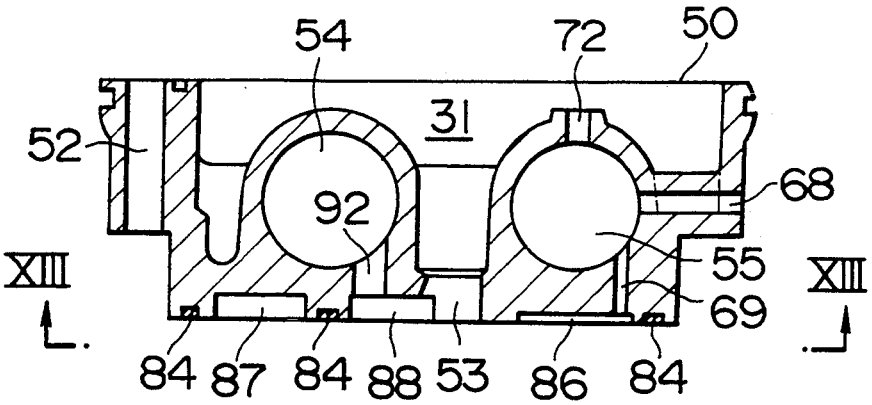
FIG. 10 RELATED ART
FIG. 10 is a sectional view taken along the line X—X of FIG. 9.
Figure 11:
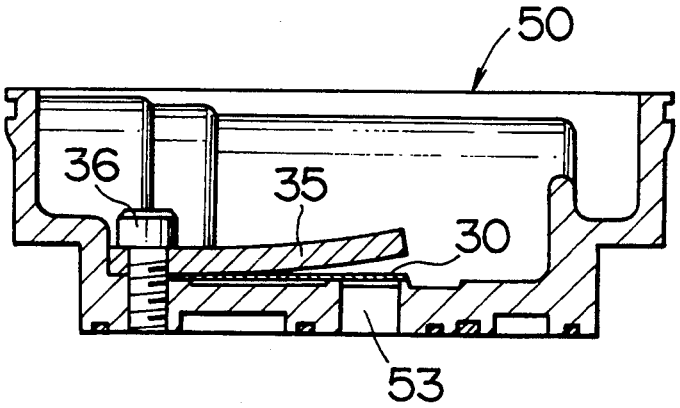
FIG. 11 is a sectional view taken along the line XI—XI of FIG. 9.

Although the first through holes 95*a*, 95*b* are formed into a triangular shape and the second through holes 96*a*, 96*b* are provided in the above-described embodiment, either the first through holes 95*a*, 95*b* or the second through holes 96*a*, 96*b* are required as shown in FIGS. 3 and 4 in order to attain the object of the present invention. Also, although the first through holes 95*a*, 95*b* are formed into a triangular shape, they may be formed as shown in FIG. 5 or FIG. 6.

In the capacity control mechanism of the present invention, the variation in pressure in the suction-side chamber can be decreased because the auxiliary through holes having a small opening area open before the first through holes open. Therefore, the hunting of the piston valve can be prevented, so that the generation of unusual noise can be prevented and the compressor can be operated stably.

If the first through holes are shaped so that the opening area at the start of the opening increases gradually along with the movement of the piston valve, the variation in pressure in the suction-side chamber at the start of opening of the first through holes can be further decreased.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A capacity control mechanism for a scroll-type compressor comprising:

a cylinder having a piston valve, the piston valve being sealingly and slidably fitted in the cylinder;

a control valve, control pressure developed by the control valve being introduced to one side of the piston valve;

a suction-side chamber communicating with suction on a side of said piston valve opposite to a side communicating with the control pressure;

a first through hole introducing gas being compressed in the cylinder to said suction-side chamber, the first through hole having a shape so that opening area thereof gradually increases during movement of the piston valve;

a second through hole introducing the compressed gas to said suction-side chamber, said first and second through holes being opened sequentially by movement of said piston valve in said cylinder along with a decrease in said control pressure, the first through hole being opened before the second through hole is opened;

an auxiliary through hole being provided in said cylinder, said auxiliary through hole having a smaller opening area than said first through hole and being opened by said piston valve before said first through hole is opened to introduce the gas being compressed into said suction-side chamber.

2. The capacity control mechanism according to claim 1, wherein the first through hole has a triangular shape.

3. The capacity control mechanism according to claim 2, wherein the triangular shape of the first through hole has an apex which is first exposed as the piston valve initially moves to open the first through hole.

4. The capacity control mechanism according to claim 2, wherein a plurality of first through holes are provided.

5. The capacity control mechanism according to claim 4, wherein opening areas of each of the first through holes are uniformly exposed as the piston valve moves such that opening areas for each of the first through holes are the same.

6. The capacity control mechanism according to claim 1, wherein the first through hole is formed by a plurality of holes.

* * * * *